United States Patent [19]

Diem

[11] Patent Number: 4,489,862

[45] Date of Patent: Dec. 25, 1984

[54] DEVICE FOR THE CONTROLLABLE REMOVAL OF BULK MATERIALS FROM CONTAINERS

[75] Inventor: Winfried Diem, Ilvesheim, Fed. Rep. of Germany

[73] Assignees: Hubert Eirich; Paul Eirich; Walter Eirich, all of Hardheim, Fed. Rep. of Germany

[21] Appl. No.: 341,910

[22] Filed: Jan. 22, 1982

[30] Foreign Application Priority Data

Jan. 31, 1981 [DE] Fed. Rep. of Germany ..... 3103274

[51] Int. Cl.[3] ..... G01F 11/00

[52] U.S. Cl. ..... 222/263; 222/630; 406/90

[58] Field of Search ..... 222/630, 263, 262, 373, 222/394, 400.7; 105/247, 248, 280; 406/90, 89, 88

[56] References Cited

U.S. PATENT DOCUMENTS

| | | | |
|---|---|---|---|
| 2,359,029 | 9/1944 | Goldberg | 222/263 |
| 3,097,889 | 7/1963 | Lenhart | 406/89 |
| 3,187,957 | 6/1965 | Rose | 222/630 |
| 3,188,144 | 6/1965 | Gmur et al. | 406/90 |

FOREIGN PATENT DOCUMENTS

| | | | |
|---|---|---|---|
| 1155717 | 10/1963 | Fed. Rep. of Germany . | |
| 2443732 | 3/1975 | Fed. Rep. of Germany . | |
| 2432737 | 1/1976 | Fed. Rep. of Germany | 222/630 |
| 2508981 | 9/1976 | Fed. Rep. of Germany . | |
| 345593 | 3/1960 | Switzerland . | |
| 355706 | 8/1961 | Switzerland | 222/630 |

*Primary Examiner*—Joseph J. Rolla
*Assistant Examiner*—Kenneth Noland
*Attorney, Agent, or Firm*—Dann, Dorfman, Herrell and Skillman

[57] ABSTRACT

For the controllable removal of bulk materials from containers, a device is provided with a gas-permeable lining facing the bulk material, which lining is mounted on a support under the container outlet, with a gas connection mounted on the support, and with a shut-off device or valve element. To achieve uniform material flow from the outlet without high expense for mechanical devices with the smallest possible structural dimensions, even for bulk materials with poor ability to flow, according to the invention, the support (7) with the gas-permeable lining (9) attached to it is designed at least partly as a valve element (5) for the container outlet (3), and that the valve element (5) is movable while clearing the container outlet (3) at least partially. For example, when materials are batched with the new device from containers into subsequent containers, it is possible to empty scales in batches in the case of negative weighing, and a satisfactory transition from batchwise emptying of a container to a continuous material flow is guaranteed.

6 Claims, 4 Drawing Figures

DEVICE FOR THE CONTROLLABLE REMOVAL OF BULK MATERIALS FROM CONTAINERS

FIELD OF THE INVENTION

The present invention concerns the controllable removal of bulk materials from containers, and relates to a valve element with a lining that is permeable to gas facing the bulk material. The element is mounted on a support underneath the container outlet, with a gas connection mounted on the support.

BACKGROUND OF THE INVENTION

A great variety of bulk materials of different grain sizes are known to be stored and transferred for processing from the storage containers into other containers, e.g., scales, volumetric measuring containers, intermediate storage containers, etc. These are entire installations with interposed conveyers, and it is obvious that the actual container is provided with a valve element, which must be opened to remove the bulk material from the container. Where the bulk materials are coarse-grained, e.g., coal, merely large rocks, etc., i.e., the bulk materials have a very good flowability, there are no difficulties in providing variable discharge openings and hence material flows by opening the valve elements more or less widely, even in the case of simple shut-off valve elements underneath the container outlet.

However, the removal of bulk materials from containers becomes problematic in the case of reduced flowability, e.g., due to high percentage of fines in the bulk material. Very fine owder, e.g., lead oxide, iron oxide, and metal oxides in general, but also mortars, cement, clays, etc., are especially critical. It is known that these fine powders, and sometimes even bulk materials with coarser grain size, flow out of the opened container outlet poorly, and tend to form bridges within the container. When the outlet tapers downwardly, the material bridges at least within the tapering container outlet.

To overcome this problem, rubber cushions have been installed at the sides of the lower zone of containers, which rubber cushions can be inflated to prevent bridge formation and to guarantee the outflow of the bulk material, when the outlet opening is cleared by the valve element. Another possibility to eliminate the bridge formation by the bulk material located in the lower zone of a container is to admit compressed air through pipe lances inserted transversely through the side walls into the container and attached to the walls, into which lances pulsating air is forced to destroy the bridges already built up in the bulk material.

A container outlet is usually closed by a valve element, which is mounted freely in such a way that is able to clear the outlet with a controlled opening size. These include eccentrically-mounted hinged doors, whose fulcrum points are on the sides along the edge of the container outlet, also centrally-mounted regulating flaps, whose pivot shafts are in the center of the material flow, as well as segment gates. Even when the bridge formed by the bulk material located in the container outlet is eliminated or avoided through the above-described measures, it is often seen as a disadvantage that despite the opening of the valve element, the bulk material fails to flow out, but instead shoots out suddenly in a partly-uncontrolled manner when a certain flap angle is reached, after which the material again becomes stuck in the outlet. These phenomena occur especially in the case of fine powders, e.g. metal oxides or cement. Therefore, paddle-wheel feeder-type sluices have been mounted in the container outlet, but these are mechanically expensive.

According to another solution, the container outlet was left open with a relatively large opening at its bottom, and a collector was installed below it at a distance, so that the bulk material always drops directly onto the collector. However, in spite of sloping an elongated collector, the bulk material remains lying on it, because it has the observed poor flow properties. Therefore, shakers have been used, and the collector has been designed as a vibrating feeder. However, it is recognized that this also represents a considerable expense due to the necessary mechanical equipment.

The expense is not lower, either, when the collector under the open container outlet is a pneumatic conveying chute. The pneumatic conveying chute extends from the zone below the container outlet to the container to which the bulk material is fed, which is often a scale. It was possible to achieve a uniform material flow along the pneumatic conveying chute to the scales with moderate success in the case of the bulk materials that are not too fine. However, even pneumatic conveying chute fails to perform in the case of very fine materials, especially when conveying metal oxides, and it is not possible to achieve a uniform material flow even when vibrators are added. Moreover, the maintenance, operating, and investment costs of such collectors in addition to the containers are disadvantageously high. The installation dimensions are also unfavorable, because an installation thus equipped requires too much space.

Another disadvantage encountered in connection with the collectors was that the material flow is fed uncontrolled into the subsequent container, e.g., scales. In spite of the uniform intake of air into the container outlets provided with a lining permeable of gas, e.g., sintered metal or screen fabric, it happens frequently that the material shoots over the pneumatic conveying chute suddenly and in an uncontrolled manner. At any rate, it has not yet been possible to shut off the material flow in time and exactly when the filling height in the scales is reached in the case of the exact batching of a bulk material into subsequent scales. Therefore, one more valve element was installed at the end of the collector. However, this implies a further disadvantageous increase in the technical expenses.

SUMMARY OF THE INVENTION

Therefore, it is the task of the present invention to create a device of the type described in the introduction to provide a uniform material flow without much expense for machinery with the smallest possible space requirement even for bulk materials with poor ability to flow. With the new device, the materials shall be collected or batched from containers into subsequent containers, e.g., it shall be possible to empty scales in batches in the case of negative weighing, and a satisfactory transition shall be guaranteed from a batch-type discharge from a container to a continuous material flow.

This task is solved according to the present invention in such a way that the support with the gas-permeable lining attached to it is designed at least partly as a valve element of the container outlet and that the valve element is at least partially movable while clearing the container outlet. By designing the valve element, i.e., the shut-off flap, the segment gate, a slide gate, etc., as a gas-permeable part, or by lining the valve element with a gas-permeable component, wherein as was mentioned above, the gas-permeable component itself, is best designed as a shut-off part, the necessary investment is far lower than in the case of the above-described known installations, and the task is still solved satisfactorily.

Specifically, according to the invention, that side of the valve element that faces the bulk material is swept over part or all its area by gases, i.e., is designed as a device distributing gas jets, so that the bulk material lying above the valve element is fluidized to a certain extent. Not only are bridges formed thereby destroyed, but the friction of the material per se against the shut-off part is reduced so much that even bulk materials with poor ability to flow can be discharged in a uniform, small material flow even in the case of small openings. In this manner, it is possible to achieve an optimal utilization of the conveyor belt during the batchwise feeding of a conveyor from several feed containers spaced apart from one another in a row, and to avoid the sudden feed of excessively large amounts of material, as has been frequently observed hitherto with the known installations.

It is also advantageous according to the present invention that the valve element is an eccentrically mounted hinged door underneath the container outlet. By this, it is meant that the hinge axis of the hinged door is offset from the central axis of the outlet, and is remote from the outlet edge of the container outlet. As was already explained in the introduction, the valve element can, of course, also be a slide gate, or a single- or double-segment gate, a centrally mounted regulating flap, etc. However, the eccentrically hinged door is an especially robust, economical and reliable element of a simple structure, by which the desired advantages according to the present invention can be achieved.

According to the present invention, the surface formed by the lower edge of the container outlet approximately defines a plane, preferably inclined to the horizontal. In the case of the above-mentioned hinged door, this is not only "approximately", but actually essentially a plane, which can be horizontal in some embodiments, namely, when the lower edge of the container outlet also defines a horizontal plane. However, if this plane is inclined with respect to the horizontal, then the substantially flat valve element, namely, the hinged door, is also inclined by approximately the same angle to the horizontal. However, when using slide gates or segmented valve elements, they may be curved and they do not always have to be symmetrical to the vertical, as is common. In such a situation the plane passing through the curved surfaces in the middle is horizontal, but the imaginary plane (of the curved surface in a first approximation) can also be inclined with respect to the horizontal. This, of course, applies to double-segment gates just as well as to two-way hinged doors.

The gas-permeable lining can also be mounted on curved as well as on flat surfaces of the shut-off parts. This lining is preferably sintered metal, sintered screen netting, cloth fabric, ceramic material, or other similar porous materials, to name just a few examples. By means of this lining, a more or less uniform distribution of gas is achieved upward into the bulk material via the gas connection mounted on the support, over variable areas, as desired.

By lining the shut-off part with the porous, gas-permeable, usually air-permeable, material, gas (mostly air) is blown in to fluidize the bulk material above it. Thus, a mininum degree of opening of the valve element is often sufficient with respect to the lower edge of the container outlet to allow the material to flow out uniformly in fluidized state. To remove the rest of the material from the container, it is possible to fully open the valve element additionally. As was mentioned already, the friction between the content of the container and the valve element is also reduced by the blowing in of the gas through the porous lining.

Even though it is possible to mount a sealing ring between the container outlet and the valve element, e.g., on the edge of the container, it is advantageous in a further embodiment of the present invention when the sealing ring is arranged on the outside around the lining on that side which faces the lower edge of the container outlet. This sealing ring can be made of rubber, asbestos, plastic, etc. Thus, a perfect seal between the fixed housing part, i.e., the lower edge of the container outlet, and the movable valve element, is guaranteed. Independently of this, there is a possibility to open or close the valve elements to different degrees, or to space them at different distances from the lower edge of the container outlet. Thus, a regulation of the discharge of the treated material flowing out of the container is achieved by means of the gas-permeable lining. In other words, it is thereby possible to change the degree of opening of the valve element by adjusting the inclination and to adjust it to the exact desired throughput.

It is also useful according to the present invention to provide gas supply devices for controlling and/or setting different amounts of gas supplied to the gas connection on the support. It is possible, for example, to set the discharge velocity of the bulk material by ajusting the degree of opening of the valve element, on the one hand, or by adjusting the amount of gas blown in through the gas-permeable lining to the material side, on the other hand. It is seen that a very simple regulation of the material flow to be removed from containers in a controlled manner can thus be achieved by means of very simple measures. In practice, the gas is normally compressed air, as is currently available in most industrial plants. It is also envisaged that a small amount of gas should be blown in through the gas-permeable lining during the charging of the container from which the bulk material is to be removed later, so that a uniform fluidization of the bulk materials is achieved in the lower zone of the container as well. In the case of emptying, it is then possible to introduce larger amounts of gas through the gas supply devices, and also to possibly provide ventilation at intervals, or to inject air jets periodically, so that all types of material, even very fine powders, can be removed from the container which certainty in a controllable manner and be conveyed to another container in batches.

The gas supply can be controlled via a solenoid valve, and the gas pressure can be set by means of a pressure reducing valve. In a preferred embodiment, an automatic circuit was provided, which controlled the air supply depending on the demand: there was ventilation prior to the opening of the shut-off part, there was permanent ventilation during the material discharges, and intermittent ventilation was provided in other applications prior to the opening and/or during the material discharge. The flap was controlled by hand in the first device, and pneumatically in an improved version.

However, other controls, e.g., by means of motors, are, of course, also possible. It is possible, for example, to set the degree of opening of the valve element and thus of the container outlet in steps or infinitely. The stepwise setting will be explained in connection with a special embodiment to be explained below.

It is especially useful for a further embodiment of the present invention when a dust-proof housing is mounted in such a way as to enclose the container outlet and the shut-off part. Specifically those bulk materials with poor ability to flow, which are hard to remove, are very fine powders. Due to the small structural dimensions of the device according to the present invention, it is therefore easily possible to house the entire closure in a dust-proof manner in a relatively small housing.

In another advantageous embodiment of the present invention, the housing is provided with a gas exhaust pipe connection. The gas supplied by the ventilation can be removed via this connection pipe, if it does not flow into the container.

Due to the small structural dimensions, existing installations can even be retrofitted with the device according to the present invention.

To mention just a few of the possible applications of the device according to the present invention: it can be used to discharge material from scales at a well-defined flow rate for being fed slowly to a subsequent process or device; it can be used to batch material from a silo to scales or to a volumetric calibrated vessel, and to discharge material from a silo loaded or charged into a subsequent material handling equipment.

There have been special difficulties in connection with the controllable removal of materials especially in the battery industry. It was often necessary to discharge lead oxide from scales into a mixer or to collect it into scales. By using a device according to the present invention, the discharge of even this bulk material with free-flowing ability no longer present difficulties.

Floor sand, cement, lime, clays (i.e., all materials that can be ventilated) can also be collected advantageously into subsequent containers, e.g., scales, and the feed containers, e.g., silos, can be installed above the scales in a simple, practical manner. However, the possible applications of the device according to the present invention cannot be described exhaustively here due to its versatility.

BRIEF DESCRIPTION OF THE DRAWING

Further advantages, charasteristics, and applications of the present invention will become apparent from the following description of preferred embodiments in connection with the drawings. Here.

DESCRIPTION OF PREFERRED EMBODIMENTS

Figure 1:
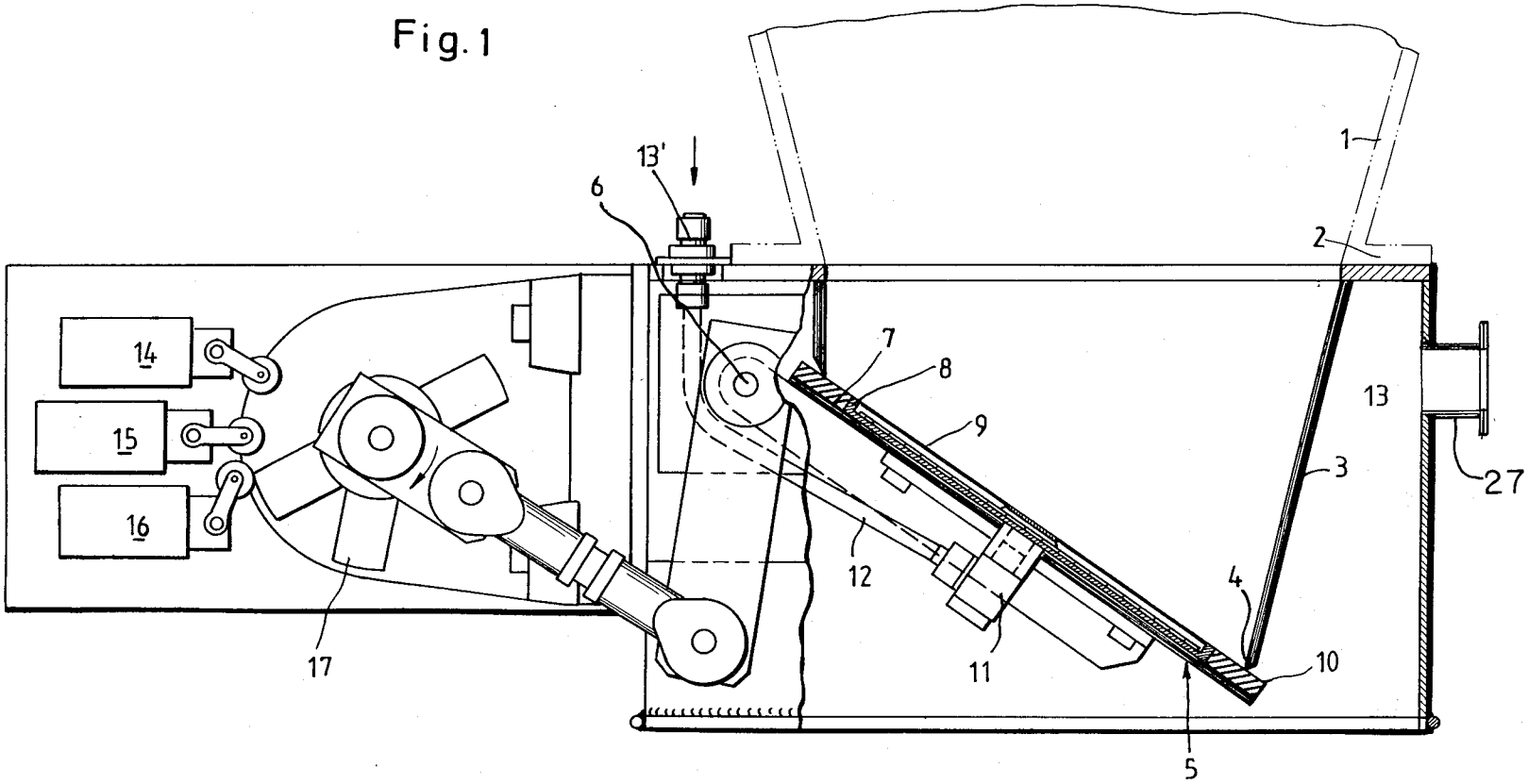
FIG. 1 shows schematically a side view of a hinged-door-type valve element with lining permeable to air on the valve element, i.e., the hinged door.

In the representation of FIG. 1, under the container 1, shown cut off, is the container outlet 3, mounted on the flange 2, whose lower edge 4 has a sharp edge, and forms an imaginary plane, which is inclined to the horizontal at an angle of approximately 45°. Parallel to this plane lies the eccentrically mounted hinged door, which is pivoted around the swivelling axis 6, and serves as the valve element 5. The hinge axis 7 is higher than the central axis of the outlet, so that when the door opens, it is displaced furthest from the lowermost portion of the inclined outlet edge 4. This hinged door consists essentially of a support 7 with an upstanding ring 8 pointing toward the side of the container outlet 3 at a distance from the outer circumference of the said support. Said ring divides that side of the support 7 which faces the container 1 into two zones. The larger circular zone is in the middle, and carries the gas-permeable lining 9, which is permeable to air in the case of the embodiments shown here. The smaller area is an annular surface, which is covered with the sealing ring 10. This ring is arranged under the sharp edge of the lower edge 4 of the container outlet 3 in such a way that a perfect sealing of the bulk material contained in container 1 from the outside is achieved, because the sealing ring is so broad that it extends from the lower edge 4 with a safety margin to the right and left. The sharp edge of the edge 4 is also designed in such a way that the sealing ring rests on the edge, providing good sealing during shut-off, even when bulk material had been discharged before, and the hinged door 5 is moving counter-clockwise around the swivelling axis 6 to close. The eccentric hinge axis 6 is remote from the sharp edge 5 of the opening, as shown in FIG. 1, so that the sealing ring 10 is displaced from the edge 4 about its entire circumference when opening, and is displaced toward the edge 4 about its entire circumference when closing. The sharp edge then presses the last remnants or grains of the bulk material to the side, left and right.

A gas connection 11, through which compressed air is supplied through the line 12 from an air supply unit in the embodiments shown in the Figures, is provided in the middle below the support 7. The solenoid valve 13' may be a flow regulator or simply an on/off valve with the conventional pressure and/or flow control means located elsewhere. Other parts of the compressed air supply unit are not shown.

The entire gate with the container outlet 3, the hinged door 5, hose 12, and the swivelling axis 6, are enclosed by the dust-proof housing 13.

Figure 2:
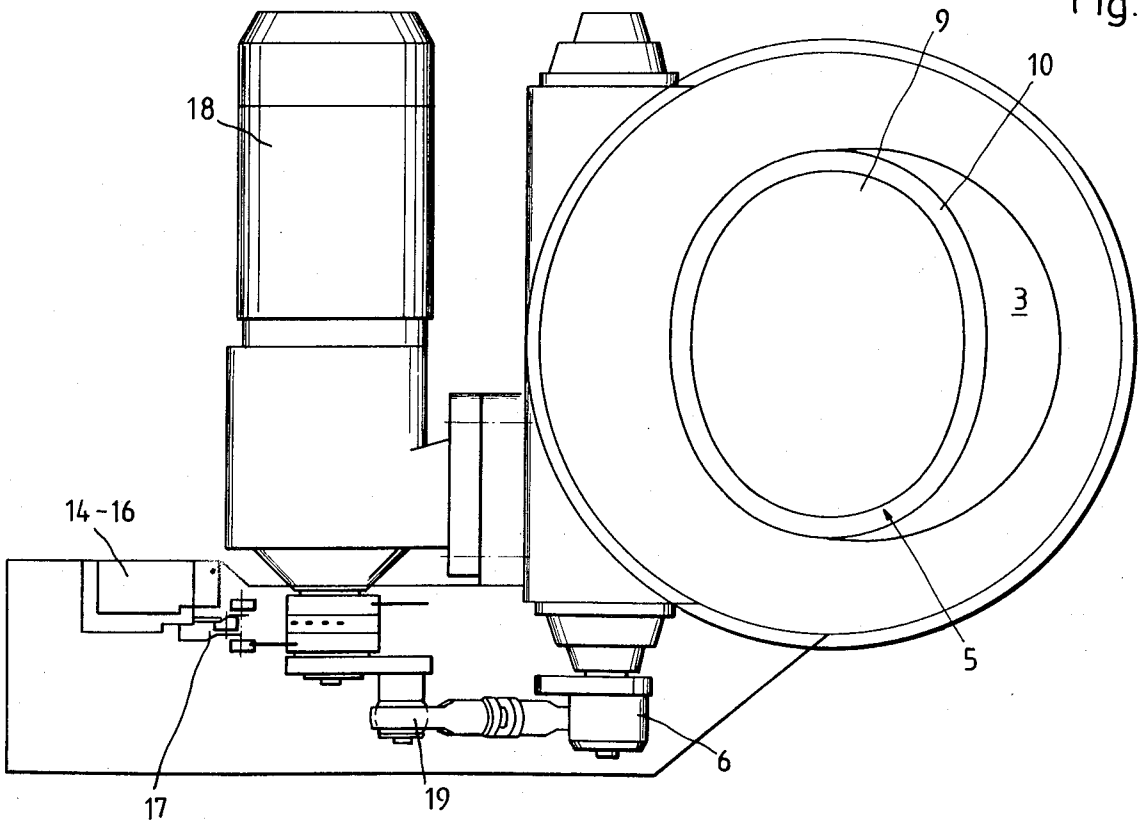
FIG. 2 shows the top view of the hinged-door-type valve element according to FIG. 1.

In the embodiment shown in FIG. 1, the hinged door is planar and inclined to the horizontal to mate with the surface formed by the edge 4 of the outlet 3. The door is actuated by the gear motor 18 and the crank drive 19 (FIG. 2). Three trip cams are actuated by cam controls 17, and the corresponding limit switches 14, 15, and 16 are actuated by the said cam controls. The limit switches preferably go to the positions "On", "Partial Opening", or "Off". The drive motor is controlled by these limit switches 14 through 16.

Figure 3:
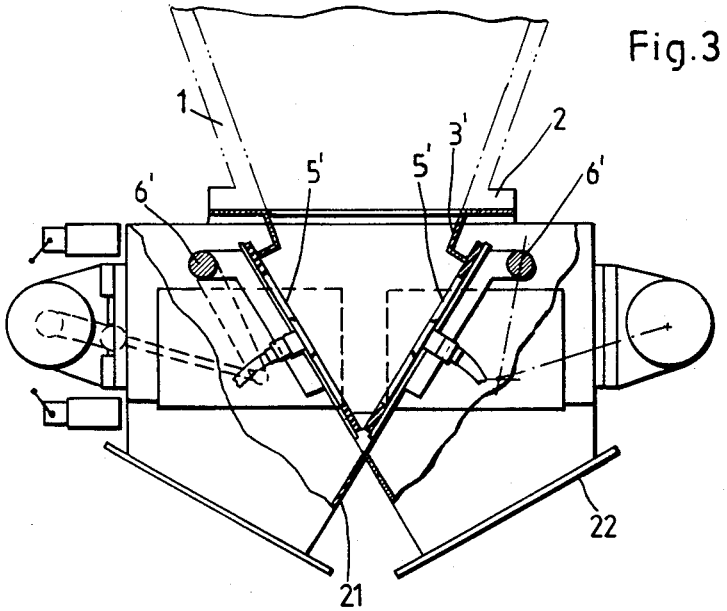
FIG. 3 shows another embodiment of a valve element, namely, a two-way gate in the shape of two hinged doors.

A similar control or the same control is also possible in the case of the embodiment according to FIG. 3. However, there are two hinged doors 5', which enclose an acute angle with one another in closed position, and these hinged doors are pivoted around the swivelling axis 6'. In the position shown in FIG. 3' there is bulk material in the short container outlet 3 down to the edge along which the two hinged doors touch one another. If the left door 5' is opened, then the bulk material flows through the left outlet 21 into a container (not shown) underneath, and when the right hinged door 5' is moved counter-clockwise, then the bulk material flows through the right outlet 22 into a, possibly different, container (not shown) underneath.

Figure 4:
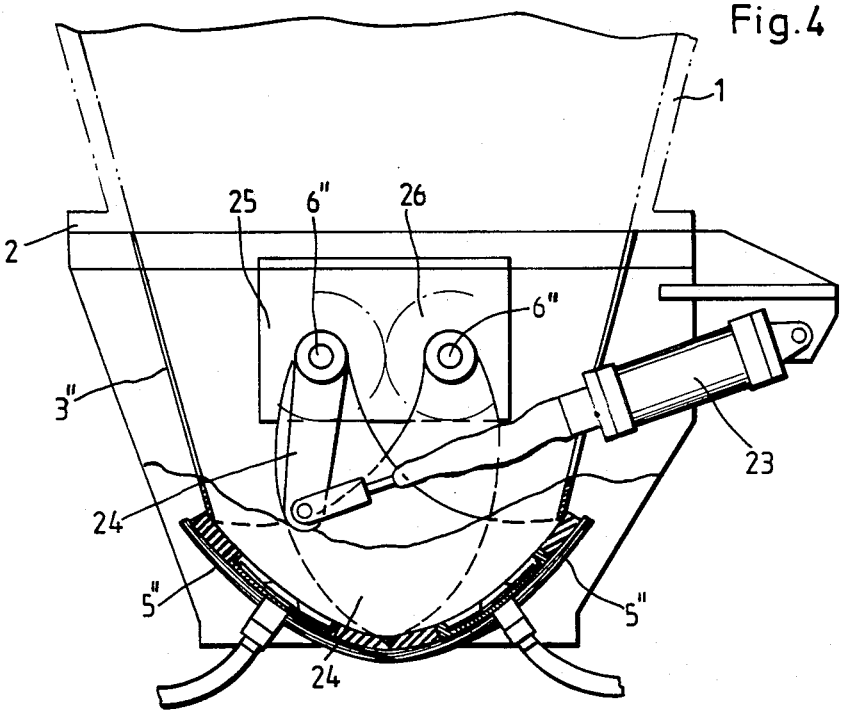
FIG. 4 shows another embodiment of a valve element designed as a double-segment gate.

FIG. 4 shows a double-segment gate, in which the shut-off parts 5'' are designed as two separate segments, which touch one another along a horizontal lower middle line. The parts 5'', in this case, are symmetrical to the vertical for sliding movement against the edges of the opening which are, in this embodiment, in a horizontal plane. If fluid is admitted to the drive cylinder 23, then it turns the segmented gate that is movable via sickle-shaped levers 24 on both sides outside the container outlet 3'' around the swivelling axis 6''. The segment gate is preferably mounted on each side outside the container outlet 3'' on such a sickle-shaped lever, and the associated drive lever 24 is also outside of the bulk material. This lever is equipped with a toothed quadrant 25, which meshes with an opposite toothed quadrant 26. This in turn in connected with a similar sickle-shaped lever for the other shut-off segment.

The gas exhaust connection pipe is designated with reference numeral 27.

I claim:

1. For a container for bulk material having at the bottom an outlet surface defined by an annular outlet edge inclined to the horizontal, said edge being sharp about its entire circumference, a hinged door constituting a valve element cooperable with said outlet edge for the controllable discharge of bulk materials from said container, said valve element having a gas-permeable lining facing the bulk material in said container and an annular sealing element surrounding said lining and registering with said annular outlet edge when said valve element is closed, said lining having a gas connection for at least partially fluidizing said bulk material in said outlet, and operator means to displace said valve element partially from a closed position closing said outlet, said hinged door being below said outlet edge, said door having a hinge axis remote from said outlet edge whereby said operator means is operable to first displace said annular sealing element from said outlet edge about its entire circumference when said door is displaced from its closed position, and upon displacement of said door into its closed position, said sharp edge cooperates with said sealing element to press the bulk material sideways out of position between said sharp edge and said sealing element, the hinge axis being offset from and higher than the central axis of the outlet so that the operator is operable to displace said element furthest away from the lowermost portion of said inclined outlet edge to afford partial discharge of said bulk material in the outlet between said lowermost edge portion and said valve element, said gas connection being constructed and arranged to afford fluidization of the bulk material by gas flowing through said lining of the valve element during displacement of said element.

2. A device according to claim 1, including gas supply lines, and means for supplying different amounts of gas to the gas connection.

3. A device according to claim 1, including a dust-proof casing enclosing the container outlet and the valve element.

4. A device according to claim 3, including a gas exhaust connection pipe for said casing.

5. A device according to claim 1, wherein said operator includes means adjusting the degree of opening of the valve element and means regulating the flow of the gas supplied to the connection so that the amount of the fluidized material being discharged from the container can be varied.

6. A valve element according to claim 1 wherein the container outlet surface is a plane, and the upper surface of said sealing element, when said valve element is closed, is coplanar with said plane and extends beyond the outlet edge to the outer periphery of said valve element, affording a free flow path about its entire circumference for discharging said bulk material in said outlet when said valve element is open.

* * * * *